United States Patent [19]

Peters et al.

[11] Patent Number: 4,471,157

[45] Date of Patent: Sep. 11, 1984

[54] PAR LAMP TERMINALS

[75] Inventors: Harvey G. Peters, Mentor-on-the-Lake; Joseph J. Wojtowicz, Novelty, both of Ohio

[73] Assignee: General Electric Company, Schenectady, N.Y.

[21] Appl. No.: 350,551

[22] Filed: Feb. 19, 1982

[51] Int. Cl.[3] ..... H01K 1/48

[52] U.S. Cl. ..... 174/50.52; 313/51; 339/145 R; 339/258 A

[58] Field of Search ..... 174/50.52; 313/49, 51, 313/113; 339/97 C, 144 R, 144 T, 145 R, 145 D, 145 T, 258 A

[56] References Cited

U.S. PATENT DOCUMENTS

| | | | |
|---|---|---|---|
| 3,445,584 | 5/1969 | Boys et al. | 174/50.52 |
| 3,569,919 | 3/1971 | Daddona | 339/258 A |
| 3,728,665 | 4/1973 | Frey | 339/97 C |
| 3,845,459 | 10/1974 | Normann | 339/191 R |
| 3,898,451 | 8/1975 | Murphy et al. . | |

*Primary Examiner*—John Gonzales
*Assistant Examiner*—D. A. Tone
*Attorney, Agent, or Firm*—John F. McDevitt; Philip L. Schlamp; Fred Jacob

[57] ABSTRACT

An improved sealed beam glass PAR lamp design is disclosed which employs a particular ferrule construction permitting electrical wire conductors to be connected thereto without soldering or screw terminals. The improved termination features physical engagement between the ferrule member and a metal contact element having flexible fingers to grip an inverted tapered wall section of said ferrule member.

5 Claims, 2 Drawing Figures

PAR LAMP TERMINALS

BACKGROUND OF THE INVENTION

PAR lamps of the glass sealed beam type commonly employ metal ferrule members that are fusion sealed to a plurality of raised bosses formed on the rear surface of the glass reflector member. Said ferrule members are generally formed as a cylindrical shell having one closed end and various type electrical terminals are commonly soldered to the closed end of the ferrule member. Electrical wire conductors are thereafter joined to said terminals by various means including screw connection, soldering, welding, and frictionally engaged connectors. Since the soldering of these conventional termination means can be labor intensive and further require that some part of the soldering be carried out during assembly of the PAR lamp in the end product, it would be advantageous to eliminate all soldering when joining electrical wire conductors to said lamp. It would be further advantageous to simplify construction of the termination means itself in achieving this objective.

Metal ferrule members having an inverted tapered contour are also known which provide increased mechanical strength when otherwise conventional electrical termination means are soldered thereto. More particularly, said prior art ferrule members are constructed with an inverted, tapered section at the closed or head end for physical engagement with a cap element of the electrical terminal secured thereto and with annular space between said elements being filled with solder. It becomes possible in this manner to reinforce the solder joint by achieving some mechanical interlocking between the joined parts to supplement the adhesive solder bond.

SUMMARY OF THE INVENTION

It has now been discovered that all of the foregoing objectives are provided with ferrule members having an inverted tapered wall section and which simply engage the electrical termination means by a physical gripping action. Specifically, the electrical termination means employed in the improved construction uses a dome-shaped metal contact element having flexible fingers to engage the inverted tapered wall section of the ferrule and dispense with any need for soldering to achieve a satisfactory electrical connection in many low voltage product applications. Said improved termination means further includes a terminal element secured to the dome-shaped metal contact element and which permits a wire conductor to be electrically connected directly thereto by a mechanical crimping action rather than soldering. The present improved sealed beam glass PAR lamp having said metal ferrule members fusion sealed to a plurality of raised bosses formed on the rear surface of the glass reflector member thereby includes each of said ferrule members having an inverted tapered wall section for engagement with electrical termination means solely by a physical gripping action, said electrical termination means comprising a dome-shaped metal contact element having flexible fingers that engage the inverted tapered wall section of the ferrule and further includes a terminal element for a wire conductor electrically connected thereto.

In a preferred embodiment, the ferrule members have a cylindrical body terminating in an inverted tapered head of smaller diameter and with said tapered head being frustoconical in shape. Said preferred lamp embodiment further includes a pair of metal ferrules being employed which are joined together with a strip of electrical insulation serving to physically support the assembled termination means.

In a different preferred embodiment, the ferrule members have a cylindrical body terminating in an inverted tapered head of smaller diameter and with said tapered head having an annular rim joined to the cylindrical body by a recessed wall section. In said preferred embodiment, the terminal element of the termination means may further include means to pierce the insulation of an insulated wire conductor when electrically connected thereto by mechanical crimping action.

DETAILED DESCRIPTION OF THE PREFERRED EMBODIMENTS

Figure 1:
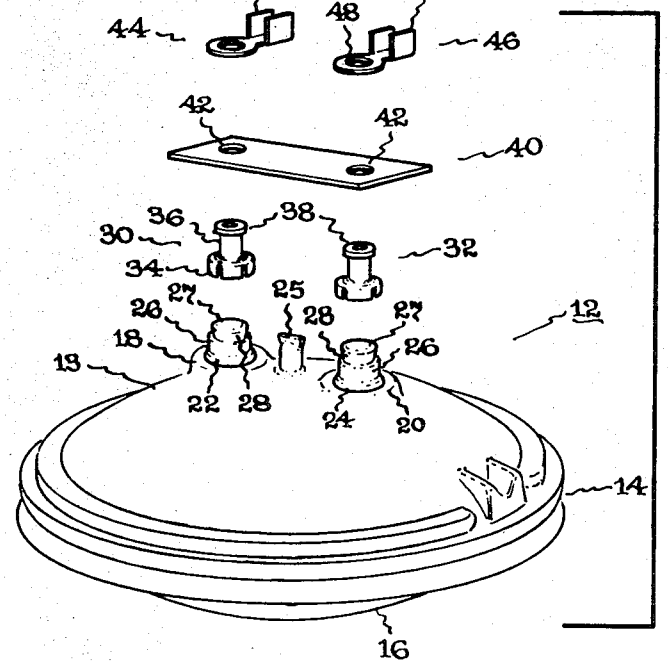
FIG. 1 depicts a preferred PAR lamp design in accordance with the present invention.

Referring to FIG. 1, there is shown an exploded view of a conventional all-glass sealed beam PAR lamp 12 with reflector member 13 being fusion sealed at the sealing rim region 14 to glass lens member 16. Raised bosses 18 and 20 formed on the rear surface of said glass reflector member 13 have metal ferrule members 22 and 24 fusion sealed thereto, respectively, in a conventional manner to provide the electrical connection to a light source located within the hermetically sealed lamp glass envelope. A conventional exhaust tube 25 also emerges from the rear of the glass reflector member in a conventional manner. Each of said ferrule members has a cylindrical body portion 28 terminating in a closed end or head 27 of smaller diameter and which further includes an inverted tapered wall section 28. A pair of dome-shaped metal contact elements 30 and 32 are employed for engagement with the aforementioned ferrule members, each of said metal contact elements having flexible fingers 34 extending from a cylindrical shank portion 36 that terminates in a larger diameter collar 38 for joinder to an electrical insulation strip forming part of said termination means. As can be further noted from the drawing, the flexible fingers 34 residing in the dome-shaped portion of said metal contact elements engage the inverted tapered wall section of the ferrule members to provide the sole means of achieving electrical connection to the light source in the lamp when said termination means has been assembled. The electrical insulation strip 40 employed in said termination means to mechanically reinforce the joinder of a pair of wire conductors (not shown) to the lamp termination includes a pair of openings 42 for conventional attachment of the contact elements in the termination means thereto. A pair of terminal elements 44 and 46 are also conventionally secured to said insulation strip beneath the collars 38 of the contact elements. An opening 48 in each of said terminal elements allows passage of the contact elements therethrough during assembly of the termination means with the collars 38 being thereafter formed during assembly. A pair of ear tabs 50 are located at one end of each contact element in order to secure a wire conductor to the termination means simply by mechanical crimping action.

Figure 2:
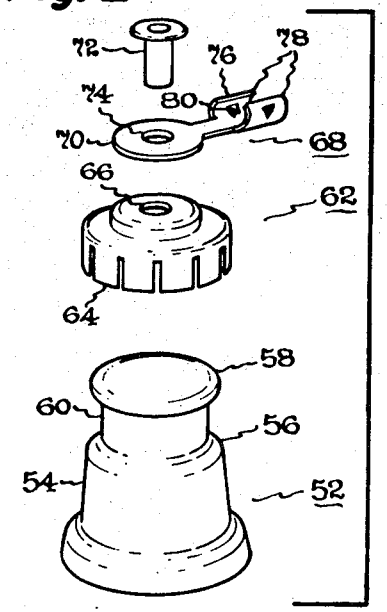
FIG. 2 depicts a different PAR lamp design also made in accordance with the present invention.

In FIG. 2 there is shown a different preferred termination means of the present invention in exploded view for cooperative association with the modified ferrule member according to the present invention. More particularly, said modified ferrule member 52 has a cylindrical body portion 54 terminating in an inverted tapered head of smaller diameter 56 and with said tapered head 56 having an annular rim 58 joined to the cylindrical body by a recessed wall section 60. The dome-shaped contact element 62 that engages the inverted tapered head portion of said modified ferrule member by a physical gripping action utilizes flexible fingers 64 and further includes an opening 66 in the dome permitting passage therethrough of a fastener when joining said contact element to the terminal element 68 in said embodiment. Said terminal element 68 includes collar portion 70 that physically engages the contact element when joined thereto with a conventional rivet 72 and which is inserted through the openings 66 and 74 provided in both joined elements. At the opposite end of said terminal element 68, there is located connector means 76 for electrical connection of an insulated wire conductor (not shown) to the termination means depicted in said embodiment. Said connector means 76 includes a pair of semicircular shaped metal tabs 78 which further include barbs or tangs 80 in order to pierce the insulation of said wire conductor when the tabs are mechanically crimped together. It will again be noted that no need exists for soldering to provide said electrical connection according to the present invention.

It will be apparent from the foregoing description that various modifications may be made in the present terminal for a PAR lamp still within the spirit and scope of the present invention. For example, variations in the contact element structure are contemplated to accomodate specific mounting needs for a particular lamp installation or lighting circuit. It is thereby intended to limit the present invention, therefore, only by the scope of the following claims.

What we claim as new and desire to secure by Letters Patent of the United States is:

1. An improved sealed beam glass PAR lamp having a glass reflector member, metal ferrule members sealed to a plurality of raised bosses formed on the rear surface of said glass reflector member, each of said ferrule members having a cylindrical body terminating in an inverted tapered head of smaller diameter, and electrical termination means engaged to the inverted tapered head portion of each ferrule member solely by a physical gripping action wherein the improvement comprises having each electrical termination means project rearwardly from each ferrule member by means of utilizing a dome-shaped metal contact element having flexible fingers to engage the inverted tapered head of the ferrule, said dome-shaped metal contact being located at one end of a cylindrical shank having a larger diameter collar at its opposite end, and with said collar engaging a terminal element with means to connect a wire conductor directly thereto by a physical gripping action.

2. An improved PAR lamp as in claim 1 wherein a pair of metal ferrules are employed and the contact elements are joined together with a strip of electrical insulation that serves to physically support the termination means.

3. An improved PAR lamp as in claim 1 wherein the terminal element is electrically connectable to the wire conductor by crimping action.

4. An improved PAR lamp as in claim 1 wherein the terminal element includes means to pierce the insulation of an insulated wire conductor when electrically connected thereto by crimping action.

5. An improved PAR lamp as in claim 1 wherein the ferrule members have a cylindrical body terminating in an inverted tapered head of smaller diameter and with said tapered head having an annular rim joined to the cylindrical body by a recessed wall section.

* * * * *